US006335066B1

(12) United States Patent
Kanda

(10) Patent No.: US 6,335,066 B1
(45) **Date of Patent: *Jan. 1, 2002**

(54) DISPOSAL CARTRIDGE WITH A RECYCLABLE TONER-CARRYING ROLLER

(75) Inventor: Shigemi Kanda, Hadano (JP)

(73) Assignee: Ricoh Company, Ltd., Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/222,732

(22) Filed: Dec. 29, 1998

(30) Foreign Application Priority Data

Jan. 7, 1998 (JP) ..... 10-001599

(51) Int. Cl.[7] ..... G03G 13/08; G03G 21/12

(52) U.S. Cl. ..... 428/40.1; 428/906; 428/35.8; 428/40.9; 399/106; 399/126; 399/277; 399/280; 399/276; 399/263; 399/262; 399/357; 399/356; 492/48; 156/215; 29/895.211; 29/895.22; 29/895.23

(58) Field of Search ..... 428/906, 35.8, 428/40.1, 40.9; 399/106, 126, 280, 277, 276, 263, 262, 357, 356; 492/48; 156/215; 29/895.211, 895.22, 895.23

(56) References Cited

U.S. PATENT DOCUMENTS

| | | | | | |
|---|---|---|---|---|---|
| 4,597,661 | A | * | 7/1986 | Yamashita | 118/658 |
| 5,303,010 | A | * | 4/1994 | Takano et al. | 355/245 |
| 5,592,268 | A | * | 1/1997 | Uehara et al. | 399/276 |
| 5,736,211 | A | * | 4/1998 | Fontanilla | 428/40.1 |
| 5,749,026 | A | * | 5/1998 | Goldie | 399/103 |

FOREIGN PATENT DOCUMENTS

JP 1310372 A * 12/1989

* cited by examiner

*Primary Examiner*—William P. Watkins, III
(74) *Attorney, Agent, or Firm*—Oblon, Spivak, McClelland, Maier & Neustadt, P.C.

(57) ABSTRACT

A disposal cartridge for use in an image forming apparatus includes a sheet and a roller. An area of the sheet is at least equal to an area of the entire circumferential surface of the roller. The sheet is detachably bonded to an entire circumferential surface of the roller. The roller attracts toner and is detachably and rotatably mounted on the disposal cartridge.

21 Claims, 2 Drawing Sheets

DISPOSAL CARTRIDGE WITH A RECYCLABLE TONER-CARRYING ROLLER

BACKGROUND OF THE INVENTION

1. Field of the Invention

The present invention relates to a disposal cartridge for use in an image forming apparatus, and more particularly to a disposal cartridge for use in an image forming apparatus with a relatively-low-cost recyclable toner-carrying roller.

2. Discussion of the Background

Designing reusable components for office machines, including image forming apparatuses such as copying machines, facsimile machines, and so forth, has become an issue in response to a recent rising tide of a recycling movement. For example, many image forming apparatuses use a disposal cartridge which typically includes a toner cartridge and a cleaning unit. Such a disposal cartridge employs rubber-made rollers, including a magnet roller for use in a cleaning operation. These rubber-made rollers have a nature of having deposits of toner lodged on surfaces thereof after a long usage. The lodged deposits of toner are generally referred to as a toner-filming problem or toner-offset problem. As a result of this toner-filming problem, at the time the rubber-made rollers are disposed of, the rubber-made rollers will be subjected to a severe cleaning process if they are, or were required to be made, reusable.

A widely-known technique for solving such a problem of the rubber-made toner carrying rollers is to coat a surface of such rollers with an agent, or a tube, having a good quality of separativeness. However, this technique adversely affects the manufacturing cost of such rollers. One reason is a relatively high material cost of the agent or the tube which has a good quality of separativeness. Another reason is a relatively complex manufacturing process of the above-mentioned technique.

SUMMARY OF THE INVENTION

Accordingly, an object of the present invention is to provide a novel disposal cartridge which includes a relatively low cost recyclable toner-carrying roller for use in an image forming apparatus.

Another object of the present invention is to provide a novel method of manufacturing a recyclable toner-carrying roller at a relatively low cost.

To achieve these and other objects, a novel disposal cartridge of the present invention for use in an image forming apparatus includes a sheet and a roller. In one embodiment, an area of the sheet is equal to an area of an entire circumferential surface of the roller. The sheet is detachably bonded to the entire circumferential surface of the roller. The roller attracts toner and is detachably and rotatably mounted on the disposal cartridge.

The sheet may have one adhesive surface. The area of the sheet may also be greater than the area of the entire circumferential surface of the roller, and an edge portion of a first end of the sheet may ride on an edge portion of an opposite end of the sheet. The edge portion of the first end of the sheet which rides on the edge portion of the opposite end of the sheet may be free or bonded to a surface of the edge portion of the opposite end of the sheet. The sheet may be made of polyethylene-terephthalate.

Also, to achieve the above-mentioned and other objects, a method of manufacturing a disposal cartridge for use in an image forming apparatus includes the steps of providing a roller that attracts toner and providing a sheet that has a surface having an area equal to an area of an entire circumferential surface of the roller. Further, the method includes the steps of detachably bonding the sheet to the entire circumferential surface of the roller, and detachably and rotatably mounting the roller on the disposal cartridge.

Other objects, features, and advantages of the present invention will become apparent from the following detailed description when read in conjunction with the accompanying drawings.

BRIEF DESCRIPTION OF THE DRAWINGS

A more complete appreciation of the present invention and many of the attendant advantages thereof will be readily obtained as the same becomes better understood by reference to the following detailed description when considered in connection with the accompanying drawings, wherein.

DESCRIPTION OF THE PREFERRED EMBODIMENTS

Figure 1:
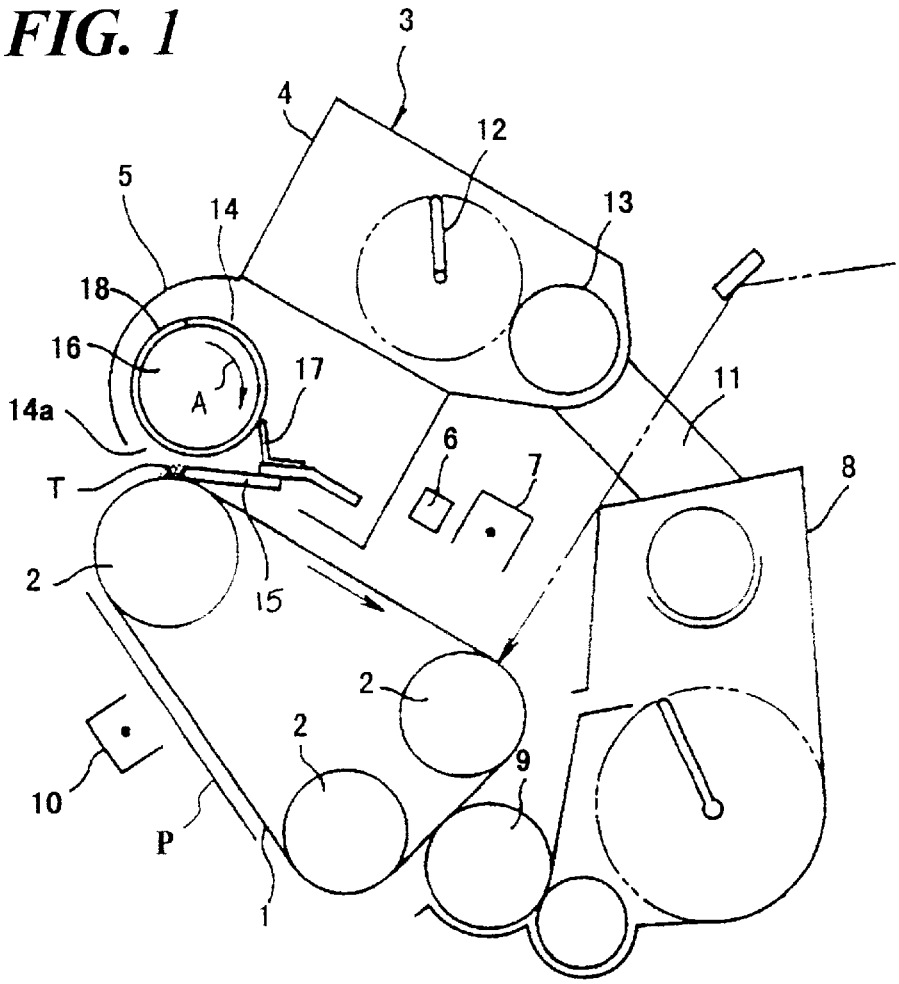
FIG. 1 is a schematic diagram for explaining a primary part of an image forming apparatus which includes a magnet roller according to an embodiment of the present invention.

In describing preferred embodiments of the present invention illustrated in the drawings, specific terminology is employed for the sake of clarity. However, the present invention is not intended to be limited to the specific terminology so selected and it is to be understood that each specific element includes all technical equivalents which operate in a similar manner.

Referring now to the drawings, wherein like reference numerals designate identical or corresponding parts throughout the several views, and more particularly to FIG. 1 thereof, a primary part of an image forming apparatus (e.g., copying machine) is illustrated as an exemplary embodiment of the present invention. The primary part of the image forming apparatus of FIG. 1 includes a photoconductive belt 1 and a plurality of rollers 2 which support and drive the photoconductive belt 1. The photoconductive belt 1 driven by the rollers 2 rotates in the direction indicated by an arrow, as shown in FIG. 1. The primary part of the image forming apparatus of FIG. 1 further includes a CTM (cleaner and toner magazine) 3 which includes a toner supply unit 4 and a cleaning unit 5 in one unit. The primary part of the image forming apparatus of FIG. 1 further includes a quenching unit 6, a charger 7, a development unit 8 which includes a development roller 9, and a transfer unit 10.

The toner supply unit 4 of the CTM 3 and the development unit 8 are connected with each other by a toner supply duct 11. The toner supply unit 4 internally includes a toner agitator 12 for agitating toner and a toner conveyer 13 for conveying toner. The cleaning unit 5 of the CTM 3 includes a toner collecting chamber 14, a cleaning blade 15, a magnet roller 16, and a scraper 17. The toner collecting chamber 14 has an opening 14*a* through which a top edge of the cleaning blade 15 protrudes to an outside of the cleaning unit 5. The magnet roller 16 is a toner carrying member which includes a sheet 18 wrapping around the rotating t surface thereof, which is explained in further detail below. In FIG. 1, letters P and T indicate a transfer paper and toner, respectively. The transfer paper P receives a toner image on a surface thereof from the photoconductive belt 1 by an image transfer operation from the transfer unit 10. The toner T remains on the surface of the photoconductive belt 1 after the image transfer operation.

Such an image forming apparatus of FIG. 1 having the above-described primary part performs a known image forming operation which is not described herein. The following description is directed to a portion of the image forming operation related to the present invention.

After a toner image is transferred onto the transfer paper P from the photoconductive belt 1 with the transfer unit 10, the cleaning blade 15 scrapes the surface of the photoconductive belt 1 to remove toner T remaining on the photoconductive belt 1. The toner T which is removed from the photoconductive belt 1 is attracted to the magnet roller 16, which is conveyed in the rotational direction A. Then, the conveyed toner is scraped off from the magnet roller 16 by the scraper 17 which makes contact with the magnet roller 16. After being scraped off from the magnet roller 16, the toner is held inside the toner collecting chamber 14. Thus, the toner T which remains on the photoconductive belt 1 is collected into the toner collecting chamber 14.

The CTM 3 which includes the above-described toner collecting mechanism is replaced when the toner supply unit 4 has no fresh toner left therein and/or when the toner collecting chamber 14 is filled with the collected toner. Since the CTM 3 includes several recyclable components, including the magnet roller 16, such recyclable components are removed from the used CTM 3 to be subjected to a reconditioning process for reuse.

During the reconditioning process, the magnet roller 16 is removed from the CTM 3. Then, the sheet 18 is removed from the surface of the magnet roller 16. At this time, the sheet 18 may have deposits of the collected toner lodged on a surface thereof. On the other hand, after the removal of the sheet 18, the magnet roller 16 has a fresh surface having no lodged deposits of the collected toner. Therefore, such a magnet roller 16 may be used again either as it is or by having a replacement sheet 18 detachably bonded onto the surface of the magnet roller 16.

Figure 2A:
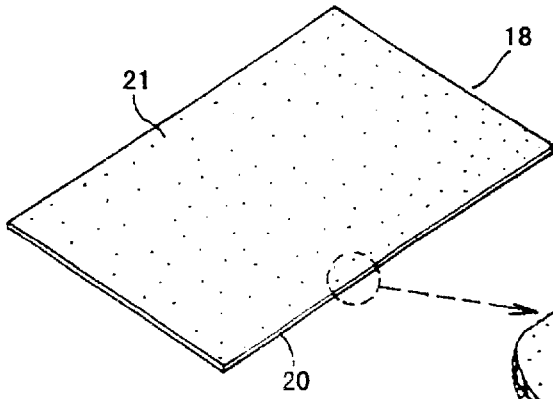
FIGS. 2A and 2B are illustrations for explaining a sheet included in the magnet roller of FIG. 1.
Figure 2B:
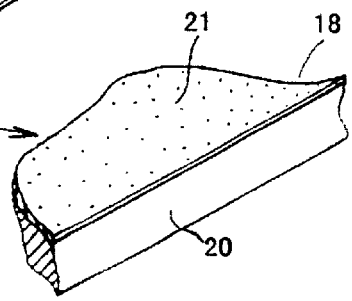
Figure 3A:
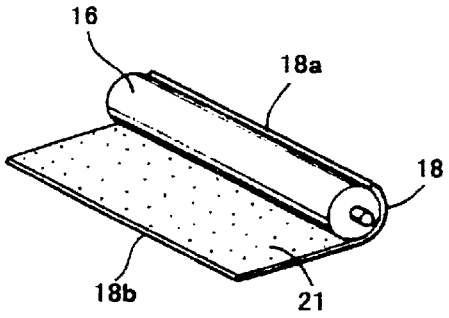
FIGS. 3A and 3B are illustrations for explaining a way that the sheet of FIGS. 2A and 2B wraps around the magnet roller of FIG. 1.
Figure 3B:
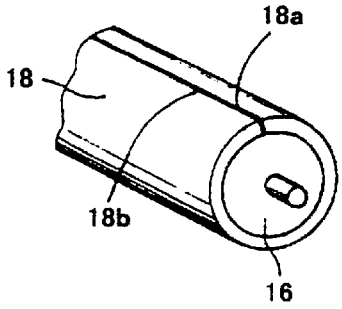

As illustrated in FIG. 2A and FIG. 2B, the above-described sheet 18 includes a base sheet 20 which is made of polyethylene-terephthalate (FTP), for example, and on which an adhesive agent 21 is coated. One way that such a sheet 18 is bonded around the magnet roller 16 is illustrated in FIGS. 3A and 3B. As illustrated in FIG. 3A, the bonding starts from a leading edge 18*a* of the sheet 18 with the adhesive agent 21 facing the surface of the magnet roller 16. At the end of bonding, as illustrated in FIG. 3B, a trailing edge 18*b* of the sheet 18 makes contact with the leading edge 18*a* without any embossment caused by the trailing edge 18*b* riding on the leading edge 18*a*. In this way, the magnet roller 16 can be wrapped with the replaceable sheet 18 around the surface thereof for an easy recycling operation.

Figure 4:
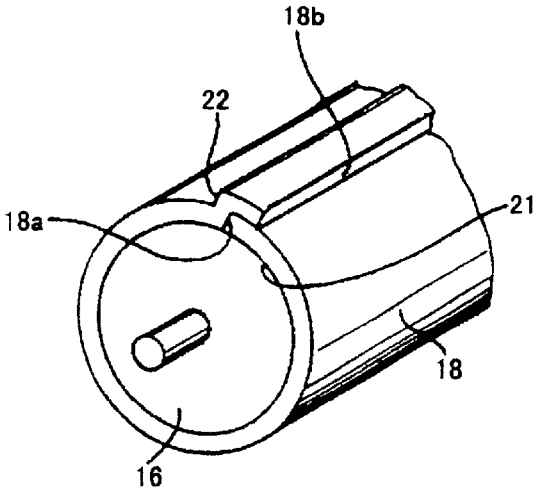
FIG. 4 is an illustration for explaining another way that the sheet of FIGS. 2A and 2B wraps around the magnet roller of FIG. 1.

Alternatively, the trailing edge 18*b* of the sheet 18 can be ended by riding on the leading edge 18*a*, as illustrated in FIG. 4. In this case, a riding portion of the trailing edge 18*b* onto the leading edge 18*a* forms a step 22, so that the sheet 18 can easily be removed by being peeled off from the step 22.

Figure 5:
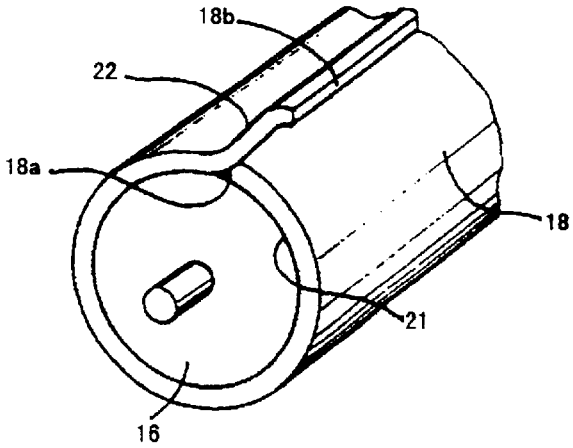
FIG. 5 is an illustration for explaining still another way that the sheet of FIGS. 2A and 2B wraps around the magnet roller of FIG. 1.

Furthermore, the step 22 on the leading edge 18*a* may alternatively be free from the surface of the sheet 18 by configuring the step 22 to have no coating of the adhesive agent 21, as illustrated in FIG. 5, so that the sheet 18 can easily be removed by being peeled off from the step 22, which step 22 can be easily pinched as it is free.

As mentioned above, the magnet roller 16 is described as only one exemplary recyclable component that carries toner in the image forming apparatus. The present invention can be applied to other toner carrying components.

In addition, the material of the sheet 18 is not limited to the above-described example, and any suitable material for which the toner carrying components do not reduce the characteristics and functions thereof can be used.

Also, the present invention can be applied to an image forming apparatus which uses a so-called process cartridge which unifies the photoconductive belt 1 and the CTM 3 into one unit.

Obviously, numerous additional modifications and variations of the present invention are possible in light of the above teachings. It is therefore to be understood that within the scope of the appended claims, the present invention may be practiced otherwise than as specifically described herein.

This document is based on Japanese patent application No. JPAP10-001599 filed in the Japanese Patent Office on Jan. 7, 1998, the entire contents of which are hereby incorporated by reference.

What is claimed is:

1. A disposal cartridge for use in an image forming apparatus, comprising:

a sheet; and a magnet roller configured to collect residual toner from a photoconductive member and configured to be detachably and rotatably mounted on said disposal cartridge, wherein said sheet is detachably bonded to an entire circumferential surface of said magnet roller during operation of said magnet roller, and an area of said sheet is at least equal to an area of said entire circumferential surface of said magnet roller.

2. A disposal cartridge of claim 1, wherein said sheet has one adhesive surface.

3. A disposal cartridge of claim 1, wherein said area of said sheet is greater than said area of said entire circumferential surface of said magnet roller, and an edge portion of one end of said sheet rides on an edge portion of an opposite end of said sheet.

4. A disposal cartridge of claim 3, wherein said edge portion of said one end of said sheet which rides on said edge portion of said opposite end of said sheet is bonded to a surface of said edge portion of said opposite end of said sheet.

5. A disposal cartridge of claim 3, wherein said sheet is made of polyethylene-terephthalate.

6. A disposal cartridge for use in an image forming apparatus, comprising:

sheet means; and roller means for collecting residual toner from a photoconductive member, and being detachably and rotatably mounted on said disposal cartridge, wherein said sheet means is detachably bonded to an entire circumferential surface of said roller means during operation of said roller means, and an area of said sheet means is at least equal to an area of said entire circumferential surface of said roller means.

7. A disposal cartridge of claim 6, wherein said sheet means has one adhesive surface.

8. A disposal cartridge of claim 6, wherein said area of said sheet means is greater than said area of said entire circumferential surface of said roller means, and an edge portion of one end of said sheet means rides on an edge portion of an opposite end of said sheet means.

9. A disposal cartridge of claim 8, wherein said edge portion of said one end of said sheet means which rides on said edge portion of said opposite end of said sheet means is bonded to a surface of said edge portion of said opposite end of said sheet means.

10. A disposal cartridge of claim 6, wherein said sheet means is made of polyethylene-terephthalate.

11. A method of manufacturing a disposal cartridge for use in an image forming apparatus, comprising the steps of:

providing a roller that attracts toner;

providing a sheet that has a surface having an area at least equal to an area of an entire circumferential surface of said roller;

detachably bonding said sheet to said area of said entire circumferential surface of said roller; and detachably and rotatably mounting said roller on said disposal cartridge.

12. A method of claim 11, wherein said sheet has one adhesive surface.

13. A method of claim 11, wherein said area of said sheet is greater than said area of said entire circumferential surface of said roller, and an edge portion of one end of said sheet rides on an edge portion of an opposite end of said sheet.

14. A method of claim 13, wherein said edge portion of said one end of said sheet which rides on said edge portion of said opposite end of said sheet is bonded to a surface of said edge portion of said opposite end of said sheet.

15. A method of claim 11, wherein said sheet is made of polyethylene-terephthalate.

16. A toner-carrying roller for use in a disposal cartridge of an image forming apparatus, comprising:

a sheet; and a magnet roller configured to collect residual toner from a photoconductive member and configured to be detachably and rotatably mounted on said disposal cartridge, wherein said sheet is detachably bonded to an entire circumferential surface of said magnet roller during operation of said magnet roller, and an area of said sheet is at least equal to that of said entire circumferential surface of said magnet roller.

17. A toner-carrying roller of claim 16, wherein said sheet has one adhesive surface.

18. A toner-carrying roller of claim 16, wherein said area of said sheet is greater than an area of said entire circumferential surface of said magnet roller and an edge portion of one end of said sheet rides on an edge portion of an opposite end of said sheet.

19. A toner-carrying roller of claim 18, wherein said edge portion of said one end of said sheet which rides on said edge portion of said opposite end of said sheet is bonded to a surface of said edge portion of said opposite end of said sheet.

20. A toner-carrying roller of claim 16, wherein said sheet is made of polyethylene-terephthalate.

21. An image forming apparatus, comprising:

a disposable cartridge which comprises:

a sheet; and a magnet roller configured to collect residual toner from a photoconductive member and configured to be detachably and rotatably mounted on said disposal cartridge, wherein said sheet is detachably bonded to an entire circumferential surface of said magnet roller during operation of said magnet roller, and an area of said sheet is at least equal to an area of said entire circumferential surface of said magnet roller.

* * * * *